US010857559B2

(12) United States Patent
Masalosalo

(10) Patent No.: US 10,857,559 B2
(45) Date of Patent: Dec. 8, 2020

(54) PAINT SHIELD ATTACHMENT

(71) Applicant: Savelio Masalosalo, Charlotte, NC (US)

(72) Inventor: Savelio Masalosalo, Charlotte, NC (US)

( * ) Notice: Subject to any disclaimer, the term of this patent is extended or adjusted under 35 U.S.C. 154(b) by 31 days.

(21) Appl. No.: 16/105,771

(22) Filed: Aug. 20, 2018

(65) Prior Publication Data

US 2020/0055070 A1 Feb. 20, 2020

(51) Int. Cl.
*B05B 12/32* (2018.01)
*B05C 21/00* (2006.01)

(52) U.S. Cl.
CPC ..... *B05B 12/32* (2018.02); *B05C 21/005* (2013.01)

(58) Field of Classification Search
None
See application file for complete search history.

(56) References Cited

U.S. PATENT DOCUMENTS 1,697,200 A * 1/1929 Morgana ..... B05B 12/20 118/505
2,359,977 A * 10/1944 Duggan ..... B05B 12/20 118/505
2,517,220 A 8/1950 Lister
2,842,094 A * 7/1958 O'Neill ..... B05B 12/36 118/301
3,091,218 A * 5/1963 Wilson ..... B05B 12/28 118/505
3,102,053 A * 8/1963 Hersey ..... B05B 12/20 118/301
5,103,762 A 4/1992 Long
5,429,677 A 7/1995 Brown
D416,771 S 11/1999 Cagle
8,104,426 B2 1/2012 Gringer
9,522,406 B2 12/2016 DeMott
2008/0092810 A1 4/2008 Kim
2008/0098956 A1 5/2008 Serfozo

FOREIGN PATENT DOCUMENTS

WO WO2009137841 11/2009

* cited by examiner

*Primary Examiner* — Jethro M. Pence

(57) ABSTRACT

A paint shield attachment for blocking overspray includes a panel and a coupler. The coupler is coupled to a first edge of the panel and is configured to couple to a respective opposing end of a plate of a paint shield so that the panel extends transversely from the plate. The panel and the plate are configured to position in contact with a surface, positioning the panel to block paint spray.

3 Claims, 4 Drawing Sheets

PAINT SHIELD ATTACHMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to painting accessories and more particularly pertains to a new painting accessory for blocking overspray.

BRIEF SUMMARY OF THE INVENTION

An embodiment of the disclosure meets the needs presented above by generally comprising a panel and a coupler. The coupler is coupled to a first edge of the panel and is configured to couple to a respective opposing end of a plate of a paint shield so that the panel extends transversely from the plate. The panel and the plate are configured to position in contact with a surface, positioning the panel to block paint spray.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
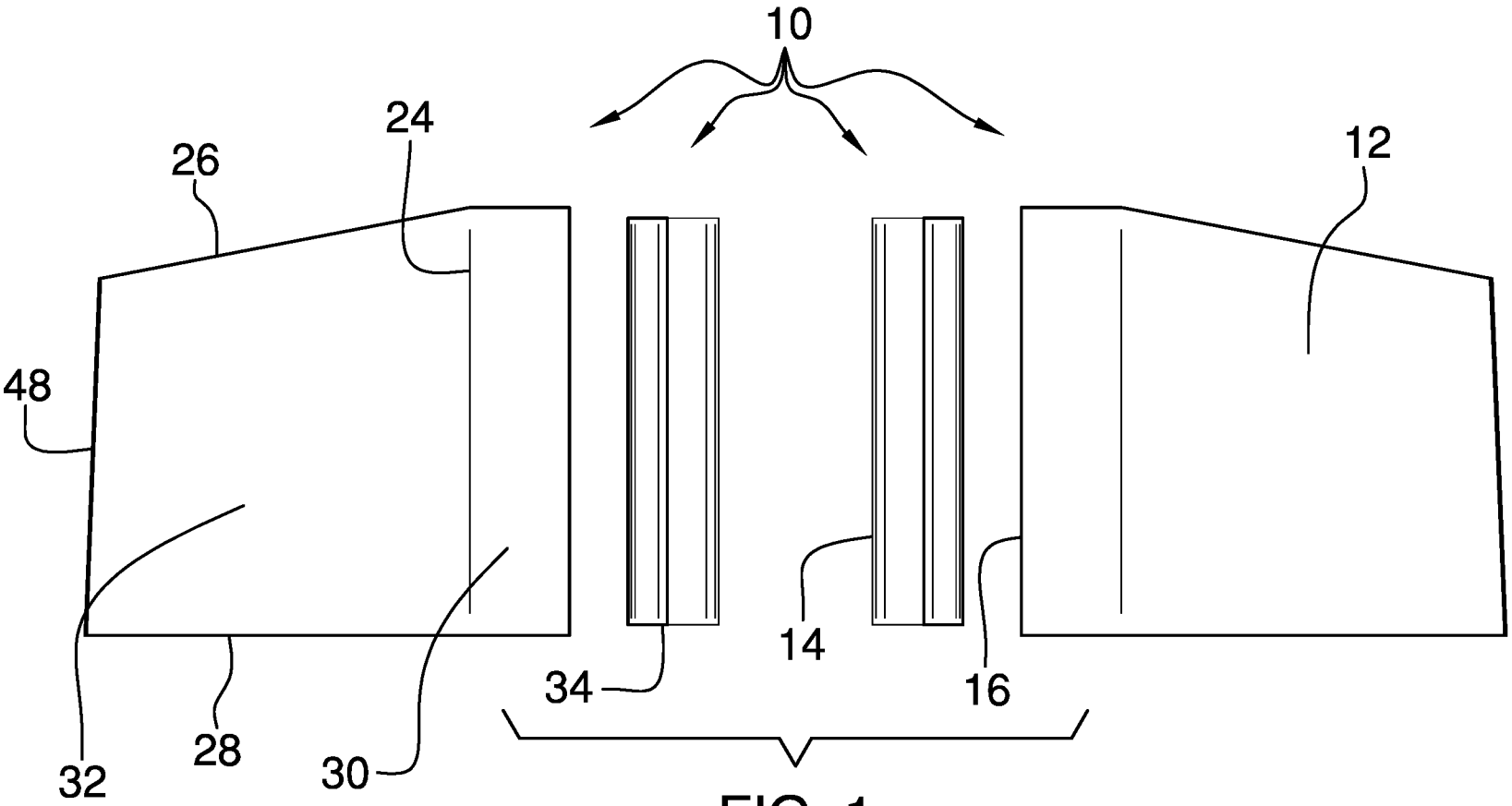
FIG. 1 is a top view of a paint shield attachment according to an embodiment of the disclosure.

With reference now to the drawings, and in particular to FIGS. 1 through 5 thereof, a new painting accessory embodying the principles and concepts of an embodiment of the disclosure and generally designated by the reference numeral 10 will be described.

As best illustrated in FIGS. 1 through 5, the paint shield attachment 10 generally comprises a panel 12 and a coupler 14. The panel 12 is substantially rectangularly shaped.

The coupler 14 is coupled to a first edge 16 of the panel 12. The coupler 14 is configured to couple to a respective opposing end 18 of a plate 20 of a paint shield 22 so that the panel 12 extends transversely from the plate 20. The panel 12 and the plate 20 are configured to position in contact with a surface, positioning the panel 12 to block paint spray.

Figure 5:
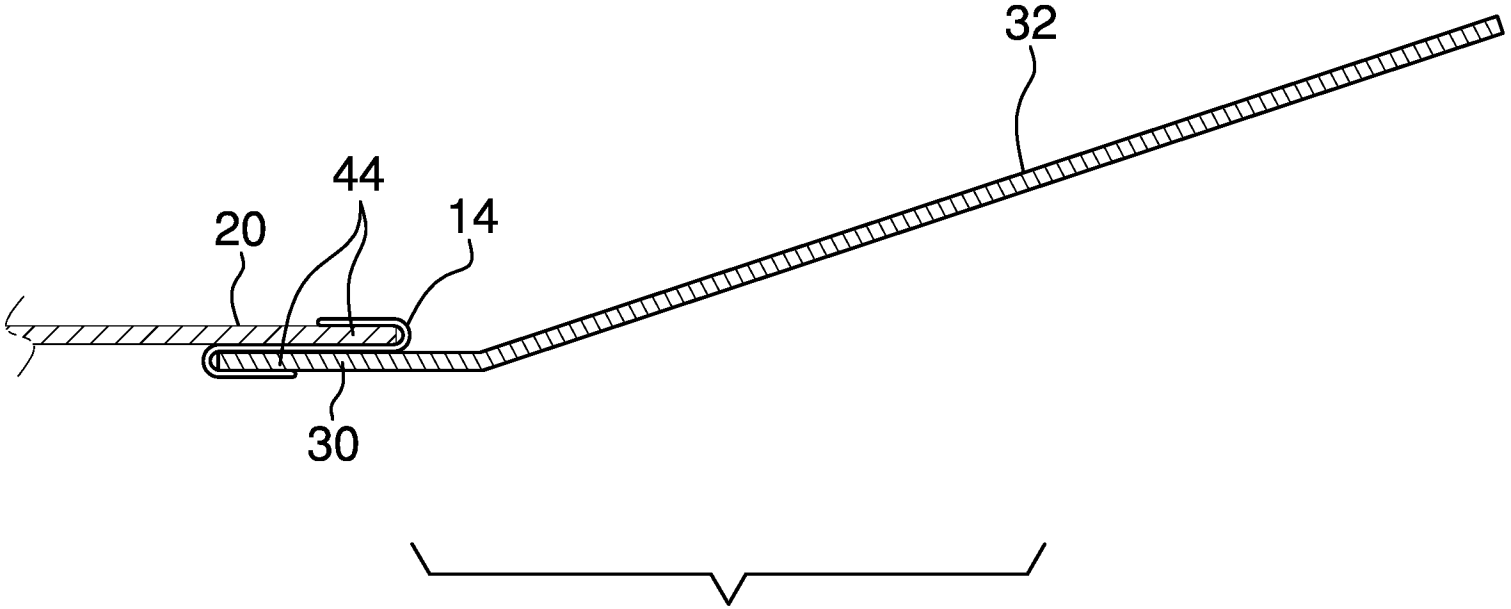
FIG. 5 is a cross-sectional view of an embodiment of the disclosure.

A reflex angle bend 24 is positioned in the panel 12, as shown in FIG. 5. The reflex angle bend 24, which extends between a first side 26 and a second side 28 of the panel 12 proximate to the first edge 16 of the panel 12, defines a first segment 30 and a second segment 32 of the panel 12. The panel 12 has a second edge 48 that is dimensionally shorter than the first edge 16 so that the second segment 32 is tapered on the first side 26 of the panel 12, as shown in FIG. 1. The tapering of the first side 26 of the panel 12 allows the plate 20 of the paint shield 22 to be positioned transversely to the surface.

Figure 3:
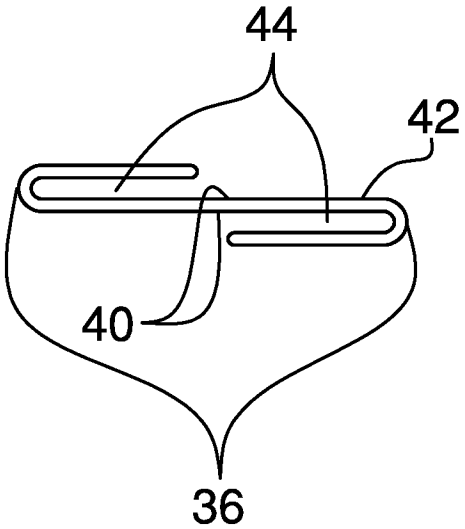
FIG. 3 is an end view of an embodiment of the disclosure.
Figure 2:
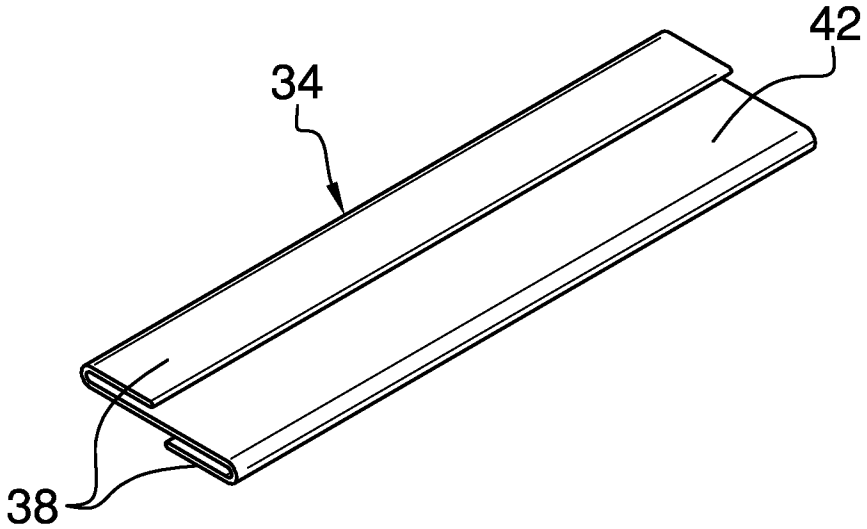
FIG. 2 is an isometric perspective view of an embodiment of the disclosure.
Figure 4:
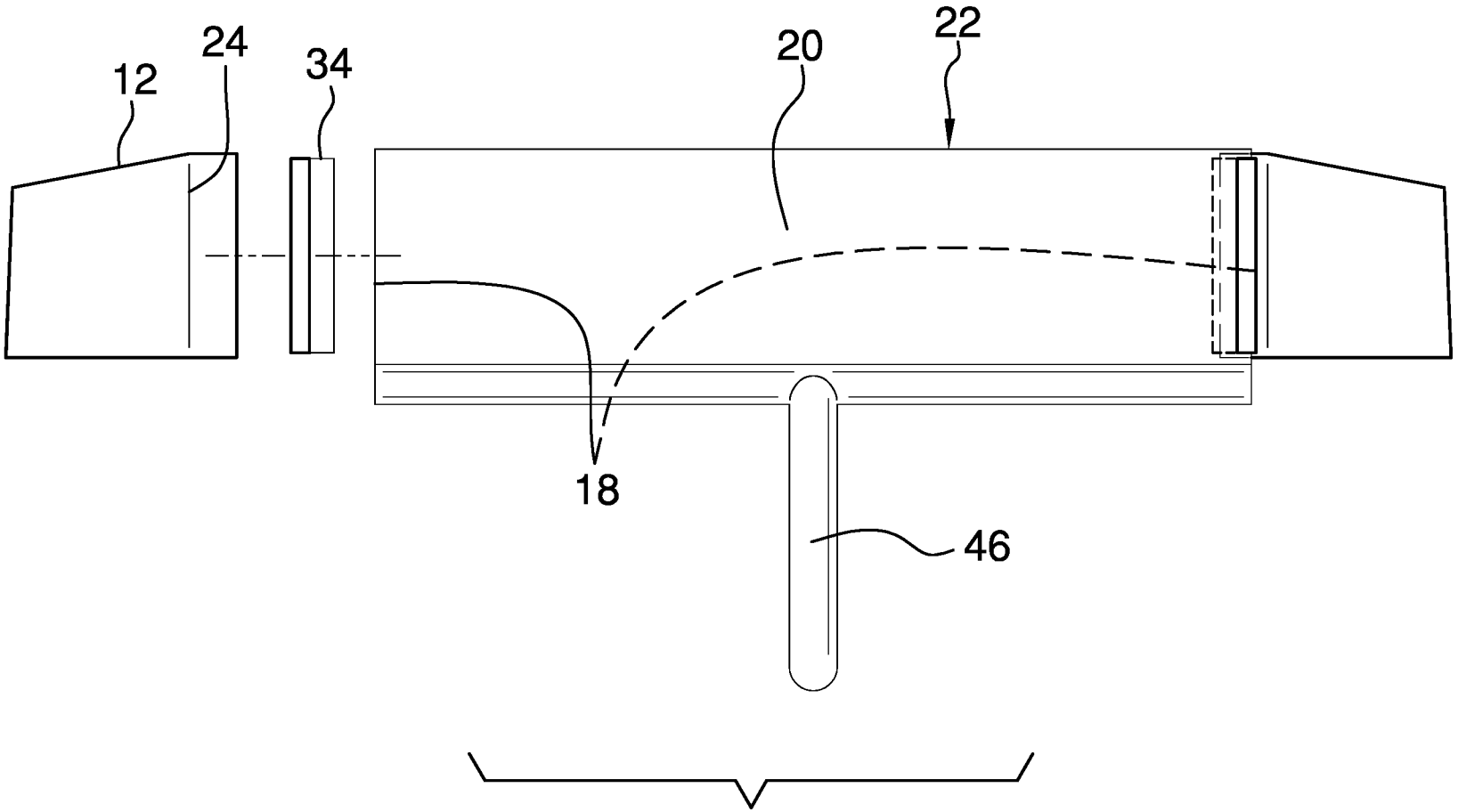
FIG. 4 is an in-use view of an embodiment of the disclosure.

The coupler 14 is removably couplable to the panel 12. The coupler 14 comprises a clip panel 34. A pair of straight angle bends 36 is positioned in the clip panel 34, as shown in FIG. 3, so that each of a pair of end sections 38 of the clip panel 34 extend in parallel over a respective opposing face 40 of a center section 42 of the clip panel 34. The pair of end sections 38 defines a pair of channels 44 that are opposingly positioned relative to the center section 42. The clip panel 34 is flattened S-shaped when viewed longitudinally, as shown in FIG. 3. Each channel 44 is positioned to selectively insert a respective one of the first segment 30 of the panel 12 and the respective opposing end 18 of the plate 20 of the paint shield 22 to couple the panel 12 to the paint shield 22, as shown in FIG. 5.

In use, each of a pair of panels 12 is coupled to a respective opposing end 18 of the plate 20 using a respective one of a pairs of clip panels 34. A handle 46 of the paint shield 22 is grasped in a hand of a user and utilized to position the plate 20 and the pair of panels 12 in contact with the surface. The user is then positioned to spray paint on the surface with the pair of panels 12 configured to block overspray of the paint.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint shield attachment comprising:

a panel, the panel being rectangularly shaped; and a coupler coupled to a first edge of the panel, the coupler being configured for coupling to a respective opposing end of a plate of a paint shield such that the panel extends transversely from the plate wherein the panel and the plate are configured for positioning in contact with a surface positioning the panel for blocking paint spray, the coupler being removably couplable to the panel;

a reflex angle bend positioned in the panel, the reflex angle bend extending between a first side and a second side of the panel proximate to the first edge of the panel defining a first segment and a second segment of the panel; and the coupler comprising a clip panel, and a pair of straight angle bends positioned in the clip panel such that each of a pair of end sections of the clip panel extend in parallel over a respective opposing face of a center section of the clip panel defining a pair of channels, the channels being opposingly positioned relative to the center section such that the clip panel is flattened S-shaped when viewed longitudinally wherein each channel is positioned for selectively inserting a respective one of the first segment of the panel and the respective opposing end of the plate of the paint shield for coupling the panel to the paint shield.

2. The attachment of claim 1, further including the panel having a second edge, the second edge being dimensionally shorter than the first edge.

3. A paint shield attachment comprising:

a panel, the panel being rectangularly shaped;

a reflex angle bend positioned in the panel, the reflex angle bend extending between a first side and a second side of the panel proximate to a first edge of the panel defining a first segment and a second segment of the panel, the panel having a second edge, the second edge being dimensionally shorter than the first edge such that the second segment is tapered on the first side of the panel; and a coupler coupled to the first edge of the panel, the coupler being configured for coupling to a respective opposing end of a plate of a paint shield such that the panel extends transversely from the plate wherein the panel and the plate are configured for positioning in contact with a surface positioning the panel for blocking paint spray, the coupler being removably couplable to the panel, the coupler comprising:

a clip panel, and a pair of straight angle bends positioned in the clip panel such that each of a pair of end sections of the clip panel extend in parallel over a respective opposing face of a center section of the clip panel defining a pair of channels, the channels being opposingly positioned relative to the center section such that the clip panel is flattened S-shaped when viewed longitudinally wherein each channel is positioned for selectively inserting a respective one of the first segment of the panel and the respective opposing end of the plate of the paint shield for coupling the panel to the paint shield.

* * * * *